US010967344B2

(12) United States Patent
Dil et al.

(10) Patent No.: US 10,967,344 B2
(45) Date of Patent: Apr. 6, 2021

(54) MAGNETIC STIRRER

(71) Applicant: HANS HEIDOLPH GMBH, Kelheim (DE)

(72) Inventors: Roman Dil, Nuremberg (DE); Sergiy Rubinshteyn, Nuremberg (DE); Michael Moskalenko, Mittelhembach (DE)

(73) Assignee: Hans Heidolph GmbH, Kelheim (DE)

( * ) Notice: Subject to any disclaimer, the term of this patent is extended or adjusted under 35 U.S.C. 154(b) by 194 days.

(21) Appl. No.: 16/300,389

(22) PCT Filed: May 2, 2017

(86) PCT No.: PCT/EP2017/060332
§ 371 (c)(1),
(2) Date: Nov. 9, 2018

(87) PCT Pub. No.: WO2017/194342
PCT Pub. Date: Nov. 16, 2017

(65) Prior Publication Data

US 2019/0134582 A1 May 9, 2019

(30) Foreign Application Priority Data

May 11, 2016 (DE) ..... 10 2016 108 749.1

(51) Int. Cl.
*B01F 13/08* (2006.01)
*H05B 3/74* (2006.01)
*B01F 15/06* (2006.01)

(52) U.S. Cl.
CPC ..... *B01F 13/0818* (2013.01); *B01F 15/065* (2013.01); *H05B 3/746* (2013.01); *B01F 2015/062* (2013.01)

(58) Field of Classification Search
CPC ..... B01F 13/0818; B01F 15/065; B01F 2015/062; H05B 3/746
(Continued)

(56) References Cited

U.S. PATENT DOCUMENTS 3,333,829 A * 8/1967 Moore ..... G05D 23/1919 366/145
3,766,360 A * 10/1973 Eddleman ..... B01L 7/00 219/415

(Continued)

FOREIGN PATENT DOCUMENTS

DE 78 20 095 U1 12/1979
DE 94 00 471 U1 4/1994

(Continued)

OTHER PUBLICATIONS

"Working for You . . . Corning Precision Coming 100V Digital Hot Plates and Stirrers", Corning, May 31, 2008.

*Primary Examiner* — Scott R Kastler
*Assistant Examiner* — Michael Aboagye
(74) *Attorney, Agent, or Firm* — Wiggin and Dana LLP; Gregory S. Rosenblatt; Thomas M. Landman

(57) ABSTRACT

A magnetic stirrer (11) comprises a magnetic drive and a placement surface (17) for a laboratory vessel containing a substance to be stirred. The magnetic drive is designed to generate a magnetic field which varies such that a magnetic stirring element can be driven to produce a stirring motion in the laboratory vessel, in order to stir the substance. The magnetic stirrer (11) also comprises a heating device (15), which is designed to heat the placement surface in order to heat up the substance, and a display device (23), which is designed to display the current temperature of the placement surface.

13 Claims, 1 Drawing Sheet

(58) Field of Classification Search
USPC ..... 366/142, 145, 146, 147, 144, 273, 274, 366/276, 279; 266/273, 233, 234
See application file for complete search history.

(56) References Cited

U.S. PATENT DOCUMENTS

| | | | | | |
|---|---|---|---|---|---|
| 4,910,372 | A | | 3/1990 | Vukich | |
| 5,529,391 | A | * | 6/1996 | Kindman | B01F 13/0818 366/145 |
| 5,549,382 | A | * | 8/1996 | Correia, II | B01F 13/0818 366/144 |
| 5,658,478 | A | | 8/1997 | Roeschel et al. | |
| 5,834,739 | A | * | 11/1998 | Lockwood | A47J 43/0465 219/468.1 |
| 7,075,040 | B2 | * | 7/2006 | McFadden | B01F 13/0006 219/443.1 |
| 7,919,731 | B2 | * | 4/2011 | McFadden | B01F 13/0006 219/494 |
| 2002/0125245 | A1 | | 9/2002 | Fuchs | |
| 2005/0183582 | A1 | * | 8/2005 | McFadden | H05B 3/68 99/348 |
| 2016/0151751 | A1 | * | 6/2016 | Eble | B01F 15/00396 366/146 |

FOREIGN PATENT DOCUMENTS

| | | |
|---|---|---|
| DE | 10 2006 005 155 B3 | 8/2007 |
| EP | 2 803 414 A1 | 11/2014 |

* cited by examiner

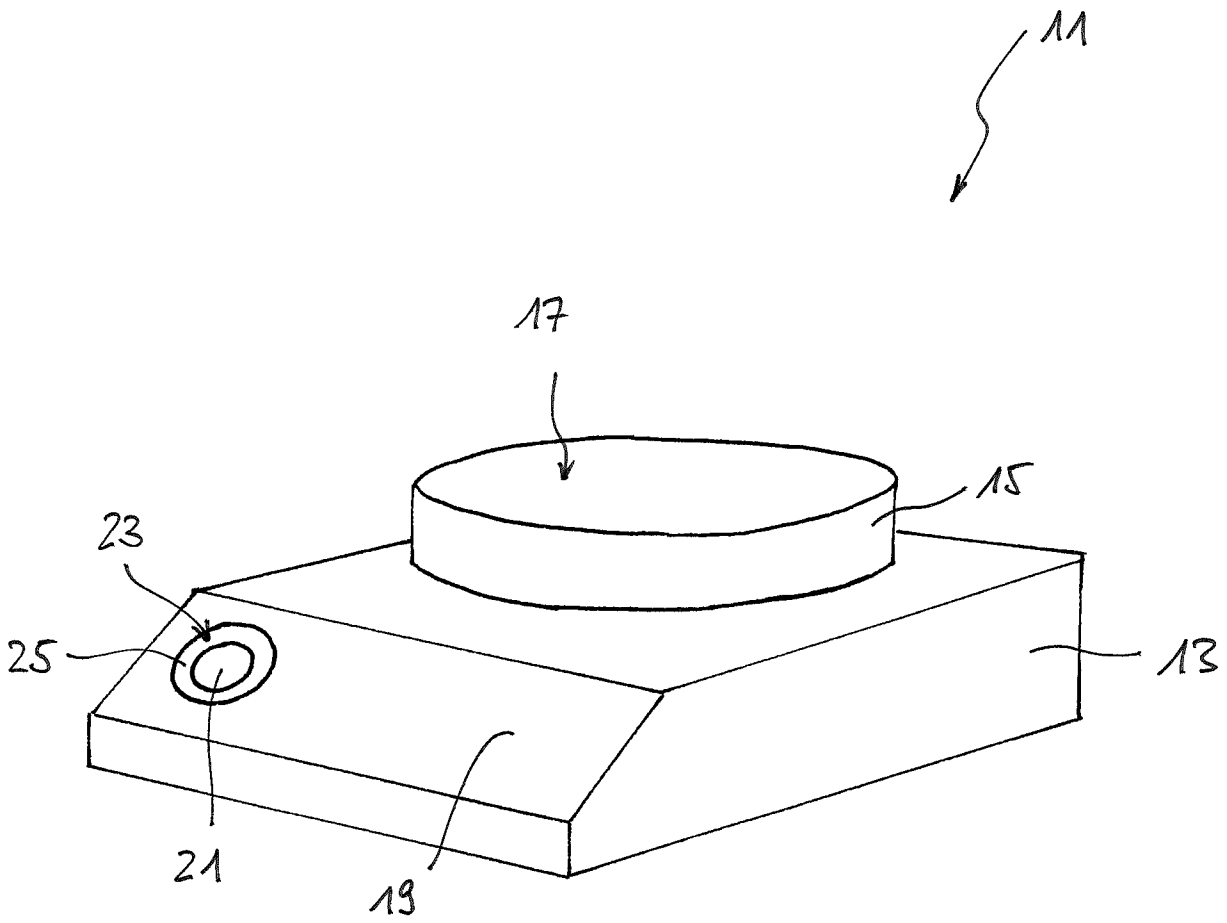
11
13
15
17
19
21
23
25

MAGNETIC STIRRER

CROSS-REFERENCE TO RELATED APPLICATIONS

This application is a national phase entry under 35 U.S.C. § 371 of International Application PCT/EP2017/060332, filed May 2, 2017, which claims priority to German Patent Application No. 10 2016 108 749.1, filed May 11, 2016, all of which are herein incorporated by reference in their entirety.

The present invention relates to a magnetic stirrer having a magnetic drive and a placement surface for a laboratory vessel comprising a substance to be stirred.

TECHNICAL FIELD

Such a magnetic stirrer represents a typical laboratory device and serves to stir respective substances as part of the most varied laboratory applications. Since the substances to be stirred as part of laboratory applications can in particular, on the one hand, be aggressive materials, for example caustic or corrosive materials, that could damage components of the stirrer or, on the other hand, substances that can in turn react sensitively to foreign substances or have to be protected from contamination for other reasons, it is advantageous for a possibility to be present to separate the location of the stirring so-to say from the stirrer, in particular to provide said location outside the stirrer.

BACKGROUND

The magnetic drive of the magnetic stirrer is for this purpose configured to generate a magnetic field varying such that a magnetic stirring element, that can be placed directly into the laboratory vessel comprising the substance to be stirred, can be driven to make a stirring movement to stir the substance. Since the substance is received in the laboratory vessel that e.g. comprises glass or plastic as the material, a direct contact of the substance with the stirrer can be avoided. Only the magnetic stirring element that is separate from the stirrer and that is in particular formed as a magnetic bar having a protective coating that is preferably inert and, for example, comprises polytetrafluoroethylene, (a so-called flea) is directly introduced into the substance to be stirred and can then be driven to make a stirring movement beyond the outer wall of the laboratory vessel by the magnetic field generated by the magnetic drive.

In this manner, only a respective magnetic stirring element that is simple to replace and in particular simple to clean comes into direct contact with the respective substance so that neither the magnetic stirrer is exposed to the respective substance nor can the respective substance be contaminated by contact with the magnetic stirrer.

The magnetic drive is preferably adjustable, i.e. can at least be switched on and off. The magnetic drive can, however, preferably also be adjusted beyond this. The magnetic drive can in particular also be adjustable with respect to the speed of the varying magnetic field and thus to the speed of the resulting stirring movement of the magnetic stirring element.

A large number of laboratory applications comprise a heating of a respective substance as a process step. Every targeted manner of heat supply is to be understood by this that can e.g. serve for a preheating, a heating, a defrosting or a boiling of the respective substance. A respective laboratory device can comprise a heating apparatus for such a purpose.

It can in particular be advantageous here also to stir the substance during heating to achieve a uniform heating of the substance over its total volume or also to simultaneously eliminate inhomogeneities of the substance by mixing. A magnetic stirrer can therefore furthermore comprise a heating apparatus, in particular an adjustable heating apparatus, that is configured to heat the placement surface to heat the substance arranged at the placement surface.

The magnetic drive and the heating apparatus of the magnetic stirrer are here preferably adjustable separately from one another, with the adjustability of the heating apparatus generally being able to be restricted, in a similar manner to the adjustability of the magnetic drive, to the possibility of switching the heating apparatus on and off. A substance arranged at the placement surface can thus be selectively stirred, heated or simultaneously stirred and heated. The heating apparatus is preferably variably adjustable beyond the simple switching on and off. A heating power of the heating apparatus can be settable, for example. The adjustability of the magnetic drive and/or of the heating apparatus can here be restricted to a respective value range, with the adjustment respectively being able to comprise a continuous and/or stepped adjustment.

The placement surface of the magnetic drive here represents that section of the magnetic stirrer at which a respective substance is arranged for stirring and/or heating. For this purpose, the placement surface is preferably horizontally aligned so that the substance, in particular a laboratory vessel containing the substance, can be simply placed onto the placement surface. On the one hand, the magnetic driving of the respective magnetic stirring element can substantially take place through the placement surface. On the other hand, the heating of the substance can take place in that the placement surface that is heated by the heating apparatus transmits heat to the substance, in particular via the laboratory vessel.

The placement surface can therefore become warm and optionally so hot during heating that a contact with the placement surface can cause pain or burns. As a rule it is here not possible to see from the placement surface itself what temperature it currently has. Particularly with a laboratory device such as a magnetic stirrer that is not used exclusively for heating, but that is frequently actually used without a heating function only within the framework of its basic function, that is for stirring, for example, there is therefore the risk of a painful burn if a user does not expect that a surface of the laboratory device could be hot. This risk is increased in that the surface can still remain hot for a certain time after the respective surface has been heated and then removed, even if the heating apparatus has already been switched off, so that a subsequent user does not have any perceivable reason to be careful of a possible hot surface.

BRIEF SUMMARY OF THE INVENTION

It is an object of the invention to reduce the risk of burns with a magnetic stirrer having a heating function.

The object is satisfied by a magnetic stirrer having the features of a magnetic drive and a placement surface for a laboratory vessel having a substance to be stirred, wherein the magnetic drive is configured to generate a magnetic field varying such that a magnetic stirring element in the laboratory vessel can thereby be driven to make a stirring movement to stir the substance, a heating apparatus that is configured to heat the placement surface to heat the substance, a display apparatus that is configured to display a respective temperature state of the placement surface, and in particular in that the magnetic stirrer comprises a display apparatus that is configured to display a respective temperature state of the placement surface.

It is therefore possible to visually recognize from the display apparatus what temperature state of the placement surface is present. In particular at least two temperature states of the placement surface must be distinguished here. The two states are in particular a hot state in which the placement surface has a temperature in a range in which a contact with the placement surface should be avoided, since the contact can be perceived as unpleasant or painful or even dangerous to the health, and a cool state in which the placement surface has a temperature in a range in which a contact with the placement surface is not critical.

The respective temperature ranges of the temperature states distinguished by the display apparatus can in particular seamlessly adjoin one another and can be respectively separated by a predefined or predefinable temperature threshold value. A respective temperature state can in this manner be associated with the placement surface of the magnetic stirrer for any temperature and can then be made visible by the display apparatus. It is possible to indicate the respective temperature of the placement surface with differently fine steps here depending on the number of distinguished temperature states.

A displayed temperature state is here in particular correlated with the temperature of the placement surface, but generally independent of a heating state of the heating apparatus. For the display apparatus should advantageously be able to warn of the actual risk of a burn, and indeed in particular when the heating apparatus has already been switched off. Conversely, it can be advantageous if it can, for instance, also be recognized through the display apparatus how long the placement surface can still be touched without danger with a heating apparatus that is already heating.

In accordance with an advantageous embodiment, the display apparatus is further configured to display a respective heating state of the heating apparatus. The magnetic stirrer could generally comprise a further display apparatus to display a respective heating state, that is in particular to display whether the heating apparatus is switched on and whether the placement surface is currently actively heating or is switched off. A respective temperature state of the placement surface and a respective heating state of the heating apparatus are advantageously, however, indicated by the same display apparatus. The display apparatus can thus be configured as particularly compact and fewer components are required for the magnetic stirrer.

The display apparatus can generally display respective temperature states of the placement surface and respective heating states of the heating apparatus specially and/or temporally separately from one another. The display of respective temperature states and of respective heating states, however, preferably takes place in a combined manner, that is in particular at least overlapping in space and time. For example, different combinations of a respective temperature state and a respective heating state can be indicated by different visual signals so that a conclusion can be drawn both on the respective temperature state of the placement surface and on the respective heating state of the heating apparatus from a single signal in each case.

Since the temperature state of the placement surface and the heating state of the heating apparatus can vary over time, the respective currently present temperature state and the respective currently present heating state are called the "respective" temperature state and the "respective" heating state respectively.

The display of a respective temperature state can take place in a large number of different manners in principle. For example, different states can be represented by different symbols of which a respective one or more can be displayed by the display apparatus. The display apparatus can, for example, comprise a monitor-like display field, for instance an LCD or TFT screen, for this purpose. A hot state can here e.g. be represented by a warning symbol. It is furthermore conceivable that different temperature states are shown in accordance with their respective temperature range by incremental symbols, for instance by a different number of lines or by bars of different lengths.

It is, however, advantageous if the display apparatus has small complexity to be able to be perceived as quickly and as unambiguously as possible. It is preferred in this connection if the display apparatus comprises an illumination element controllable to transmit light and is configured to control the illumination element to transmit light having respectively different illumination characteristics to indicate different temperature states of the placement surface and/or different heating states of the heating apparatus. A plurality of different temperature states and optionally also a plurality of different heating states can thus be indicated by transmitting a respective specific illumination characteristic by the same illumination element.

The illumination element can, for example, be a signal light, for instance a lamp. The illumination element can also comprise an illumination surface that can in particular be backlit by a light source. Such an illumination surface can then have a shape that can be selected with respect to good perceptibility and/or a pleasing design. A symbol can in particular also be represented by the shape of an illumination surface of the illumination element, for instance in that the illumination surface is shaped in the manner of a warning triangle and/or of a flame to warn of a hot placement surface.

Different illuminants can be considered as the light source of the illumination element. At least one LED is preferably provided due to the small power requirement and the small thermal irradiation. The illuminant can, however, in particular also comprise a different kind of electroluminescent element as the light source.

In this embodiment, a plurality of different respective temperature states of the placement surface can preferably be indicated by the same illumination element so that the temperature states cannot be distinguished with respect to different illumination elements. They can, however, instead be identified with respect to different illumination characteristics transmitted by the illumination element. In this respect, a specific kind of transmission of light for a respective state by the illumination element is called an illumination characteristic. Respective illumination characteristics for indicating different temperature states of the placement surface can in particular be distinguished with respect to the respective duration, pulse frequency, pulse duration, pulse break duration, pulse sequence, spatial extent, color and/or brightness of the transmitted light.

For example, a temperature state corresponding to a high temperature can be indicated by brighter light than a temperature state corresponding to a lower temperature. In a similar manner, a temperature state can be indicated by a respective specific color of the transmitted light, with e.g. a progression from green over yellow and orange to red being able to correspond to ever high temperatures of the placement surface, and vice versa. The light here does not have to be continuously transmitted, but can rather be differently pulsed depending on the indicated state. It is hereby generally possible to encode a plurality of different states by a respective different pulse sequence, for instance in the manner of Morse code.

However, temporal patterns having a small complexity are to be preferred for a simple identification of the respective indicated state. There can in particular be a simple, in particular at least substantially linear, relationship between the pulse frequency, the pulse duration (duration of a single pulse) and/or the pulse break duration (duration of the time period between two pulses) and a mean temperature of the respective temperature state of the placement surface.

A regular increase and decrease of the intensity of the transmitted light is in particular here to be understood as a pulsing or pulsed transmission of light. The intensity here in particular drops to zero between two pulses. The transition between the maximum and minimum intensities can be abrupt in the manner of a step function (which can correspond to a flashing) or can take place continuously, for example in the manner of a triangular function, saw tooth function, or sine function.

In accordance with an advantageous further development, the display apparatus is configured to control the illumination element to transmit light in accordance with a first illumination characteristic, in particular constantly illuminating light, for a display of a switched on state of the heating apparatus; to control the illumination element to transmit light in accordance with a second illumination characteristic, in particular pulsing light, for a combined display of a switched off state of the heating apparatus and of a hot state of the placement surface; and/or to control the illumination element to transmit light in accordance with a third illumination characteristic, in particular no light, for a combined display of a switched off state of the heating apparatus and of a cool state of the placement surface.

In this embodiment, a combined display of the respective temperature state of the placement surface and of the respective heating state of the heating apparatus therefore takes place. A distinction can in particular be made here with reference to the respective mutually different illumination characteristics as to whether the heating apparatus adopts the switched on state in which light in accordance with the first illumination characteristic is transmitted or the switched off state. If the heating apparatus adopts the switched off state, a distinction can further be made with reference to respective further illumination characteristics between at least a hot state and a cold state.

Provision can be made here that as long as the switched off state of the heating apparatus is present, that is the heating apparatus is switched on, the respective temperature state of the placement surface is not displayed. The illumination element can here rather illuminate continuously and independently of respective temperature states of the placement surface in accordance with the first illumination characteristic.

The first illumination characteristic preferably comprises the fact that the illumination element illuminates constantly, that is with a continuous intensity, in a non-pulsed manner, in one color, e.g. red. It hereby becomes clear in a simple manner that heating is actually taking place and a contact with the placement surface should therefore be avoided.

Unlike a simple indication of function of the heating apparatus that illuminates during heating and is completely extinguished on a switching off of the heating apparatus, the illumination element in this embodiment, however, also still transmits light when the heating apparatus is switched off and thus adopts its switched off state. This further transmission of light takes place here for so long as the placement surface still adopts the hot state, that is a state in which the placement surface is still so hot that it should not be touched. However, so that it becomes clear that the placement surface still only irradiates its residual heat, but is no longer actively heated, the illumination element now transmits light with a changed illumination characteristic, namely in accordance with the second illumination characteristic.

The second illumination characteristic preferably comprises pulsing light. Since the intensity of the transmitted light is not constant here, but rather increases and decreases regularly, this illumination characteristic can be distinguished in a simple manner from the first illumination characteristic of the switched on heating state.

Only when the placement surface adopts the cool state, that is has in particular cooled below a predefined temperature threshold below which a contact of the placement surface is unproblematic, is the light in accordance with a third illumination characteristic transmitted. The cool state of the placement surface and the switched off state of the heating element are thus simultaneously indicated by this illumination characteristic in accordance with which the illumination element preferably does not transmit any light.

In principle, even further illumination characteristics can be provided for characterizing further states. It can, for example, be advantageous also to distinguish between at least a hot state and a cool state of the placement surface by different illumination characteristics in the switched on state of the heating apparatus. More than one hot state of the placement surface can furthermore be distinguishable in that a respective different illumination characteristic is associated with each hot state. A gradual change of the temperature state of the placement surface is then preferably indicated by a change of the transmitted illumination characteristic that is gradual in a comparable manner so that the change can be particularly intuitively understood.

In accordance with a further advantageous development, the display apparatus is configured to control the illumination element to transmit pulsing light of different pulse frequencies for a combined display of a switched off state of the heating apparatus and of different hot states of the placement surface. The pulse frequency of the transmitted light here therefore depends on the respective hot state of the placement surface. Hot states that correspond to hotter temperatures can in particular have a higher pulse frequency than hot states that correspond to lower temperatures. An intuitive understanding of the respective temperature state of the placement surface is hereby made possible. In addition, faster pulse frequencies are as a rule perceived more easily and faster so that the perception of the display apparatus is advantageously the easier, the higher the temperature of the placement surface and thus the risk for a user is. The temperature of the installation surface can generally be made recognizable in any desired fine steps depending on the number of different hot states of the placement surface.

In the above-explained embodiments, the respective illumination characteristics can be additionally different, in particular in color, for instance, for a further clarification of respective states of the magnetic stirrer so that, for example in the switched-on state of the heating apparatus and in the hottest of the hot states of the placement surface, the illumination element transmits red light and the color changes from red over orange to yellow with a decreasing pulse frequency by which a temperature decrease is signaled.

In accordance with a further advantageous embodiment, the magnetic stirrer comprises an actuation element, in particular for switching and/or adjusting the heating apparatus, with the display apparatus being provided at the actuation element. The display apparatus can in particular be arranged encompassing the actuation element or can be integrated into the actuation element. Such an actuation element can serve only the switching of the heating apparatus, that is can be functionally restricted to switching the heating apparatus on or off. The actuation element can, however, also serve to adjust the heating apparatus beyond this, that is, for instance, to set a heating power of the heating apparatus. The actuation element that has to be actuated manually as a rule can, for example, be a rocker switch, a push button, a rotary knob, or similar, with such actuation elements also being able to be implemented or reproduced by touch-sensitive, in particular capacitive, input elements such as touch elements. Since the actuation element is at least configured to switch the heating apparatus on and off, preferably also for a further adjustment of the heating apparatus, a spatially directly visual feedback of the respective adjustment can take place in that the display apparatus is provided at the actuation element.

The actuation element can for this purpose be surrounded at a plurality of sides by the display apparatus, in particular by an illumination surface or by said illumination element of the display apparatus, with the display apparatus not necessarily having to surround the actuation element over the full periphery. Alternatively or additionally, the display apparatus can be integrated in the actuation element, for instance in that the actuation element is at least regionally transparent and this region is backlit so that the region acts as an illumination surface of the display apparatus.

In accordance with a further embodiment, the magnetic stirrer comprises a temperature sensor for detecting a respective temperature of the placement surface, wherein the display apparatus is configured to determine and display the respective temperature state of the placement surface in dependence on the respective temperature detected by means of the temperature sensor. A simple platinum measuring resistor can be used as the temperature sensor, for example. The temperature sensor preferably generates a signal that represents the respective temperature of the placement surface and that is received by the display apparatus or by a control apparatus of the display apparatus. The respective temperature state of the placement surface can be determined there in that a respective temperature state is selected from predefined temperature states with reference to the signal. This temperature state can then be subsequently displayed, for example in that the illumination element is controlled to transmit a respective illumination characteristic associated with this temperature state.

In accordance with a further embodiment, the magnetic stirrer comprises a base unit having a common power supply for the magnetic drive, for the heating apparatus, and for the display unit, with the heating apparatus, in particular a hotplate, being formed separately from the base unit, being arranged at the base unit, and having the placement surface. The display apparatus is then preferably provided at the base unit.

Said actuation element can in particular be provided at the base unit and the display apparatus can then, as explained further above, be provided at the actuation element. It is admittedly generally also possible to provide the display apparatus directly at the heating apparatus so that the temperature state of the placement surface can advantageously be displayed close to or even in the placement surface itself. The arrangement of the display apparatus at or in the base unit in contrast has the advantage that it can there more easily be provided with power and is exposed to at least a smaller degree to the heat generated by the heating apparatus.

A magnetic stirrer in accordance with the invention provides a greater security against accidental burns in comparison with conventional magnetic stirrers having a heating function through a simple, optionally also retrofittable, display apparatus. This display apparatus allows a user of the magnetic stirrer to recognize in a fast and intuitive manner whether the placement surface still has residual heat from a preceding heating so that a touching of the placement surface should be avoided. In general, such a residual heat display in accordance with the invention can also be provided having comparable advantages as in a magnetic stirrer in other typical laboratory devices that also have an additional heating function beside a basic function.

BRIEF DESCRIPTION OF THE DRAWING

The invention will be described in the following only by way of example with reference to the FIGURE.

FIG. 1 shows an embodiment of a magnetic stirrer in accordance with the invention in a very simplified schematic representation.

DETAILED DESCRIPTION

A magnetic stirrer 11 is shown in very simplified form in FIG. 1 as an example of a laboratory device having a residual heat display in accordance with the invention. The magnetic stirrer 11 comprises a base unit 13 that is configured as a flat parallelepiped having a chamfered upper front edge. A heating apparatus 15 that has a flat cylindrical shape is arranged at the upper side of the base unit 13. The upwardly facing front section of this shape is configured as a hotplate that can be heated. The front surface of the cylindrical shape simultaneously forms a placement surface 17 of the magnetic stirrer 11.

A laboratory vessel comprising a substance to be stirred and/or to be heated can be placed on the placement surface 17 that is horizontally aligned on a conventional arrangement of the magnetic stirrer 11 with its lower side on a planar surface such as a tabletop. For the stirring of the substance, a magnetic stirring element, in the manner of a so-called flea, for instance, is introduced into the substance and can be driven through the lower side of the laboratory vessel to make a stirring movement.

A magnetic drive, not visible from the outside, is provided in the interior of the magnetic stirrer 11 for this purpose. It is configured to generate a magnetic field in a region adjacent to the placement surface and above the placement surface, said magnetic field then being able to exert magnetic forces on the magnetic stirring element, in particular such that the magnetic stirring element at least substantially rotates about the cylinder axis of the cylindrical shape of the heating apparatus 15. In this manner, a stirring movement of the magnetic stirring element can be induced in the middle of the substance to be stirred by the magnetic drive provided in the interior of the magnetic stirrer 11.

The heating apparatus 15 that can extend at least partly also into the interior of the magnetic stirrer 11 comprises at least one electrical heating element that thermally contacts the placement surface 17. The heating apparatus 15 can heat the placement surface 17 in this manner so that heat can be transmitted from the placement surface 17 to the respective substance placed on the placement surface 17 to heat the substance. So that the placement surface 17 is heated as homogeneously as possible, said front side of the cylindrical shape of the heating apparatus 15 comprises a material having a high thermal conductivity, in particular a metal. To avoid heat being transferred from the placement surface 17 to the base unit 13, a gap can be provided between a lower edge of the jacket surface of the cylindrical shape and the upper side of the base unit 13.

The magnetic drive and the heating apparatus 15 are supplied with power by a common power supply that is integrated in the base unit and has a connector for connecting a mains plug. The magnetic drive and the heating apparatus 15 are adjustable at least to the extent that they can generally be switched on and off independently of one another to selectively stir and/or heat the respective substance.

Said chamfer of the upper front edge of the parallelepiped shape of the base unit 13 forms an operating surface 19 of the magnetic stirrer 11 at which a plurality of actuation elements 21 are arranged for the adjustment of the magnetic stirrer 11.

The actuation elements 21 in particular serve to switch the magnetic drive on and off and to set a speed of change of the magnetic field to thereby set the speed of the stirring movement or to switch the heating apparatus 15 on and off and to set a heating power of the heating apparatus 15 to set the speed of heating.

Only a single one of these actuation elements 21 is shown that is formed as a flat push button or as a touch element and by whose actuation the heating apparatus 15 can be alternately switched on and off. A display apparatus 23 of the magnetic stirrer 11 is provided at the push button 21 and comprises as the illumination element 25 a light permeable illumination surface that is backlit by a light source in the form of multi-color LEDs. This illumination surface surrounds the at least substantially round push button 21 in annular form. The supply of the display apparatus 23 with power takes place via the same power supply that is also provided for the magnetic drive and for the heating apparatus 15.

The display apparatus 23 is configured to light continuously with a constant brightness and color, in particular red, on a switching on of the heating apparatus 15 and for the duration of the switched on state of the heating apparatus 15. A switched off state of the heating apparatus 15 can furthermore generally be indicated by the display apparatus 23 in that it does not light up. A distinction can at least be made in this manner with reference to the display apparatus 23 whether the switched on heating state or the switched off heating state 15 is present.

In addition, the display apparatus 23 is, however, also configured to display a respective temperature state of the placement surface at least when the heating apparatus 15 is switched off. For if the heating apparatus 15 has heated the placement surface 17 and is then switched off, the placement surface 17 can have a residual heat that only gradually drops. To warn of this residual heat as required to avoid any painful touching of the still hot placement surface 17, the display apparatus 23 can control the illumination element 25 to transmit light with an illumination characteristic different from said constant illumination for at least so long as the placement surface 17 has an unpleasantly high temperature.

In this respect, a high residual heat, that is a respective temperature of the placement surface 17 in a high temperature range, for example above 100° C., can in particular be signaled by an illumination of the illumination surface of the display apparatus 23 flashing at a high frequency, for example approximately 5 Hz. A reduction of the temperature over time can further be indicated in that the flashing frequency drops correspondingly continuously or in steps. The flashing frequency can, for example, amount to 4 Hz for temperatures between 80° C. and 100° C., to 3 Hz for temperatures between 60° C. and 80° C., to 2 Hz for temperatures between 50° C. and 60° C., to 1 Hz for temperatures between 40° C. and 50° C., and to 0.5 Hz for temperatures between 30° C. and 40° C. Different comparable associations of the flashing frequencies with temperature ranges can, however, also be present.

To detect the respective temperature of the placement surface 17, the magnetic stirrer 11 has a temperature sensor in the region of the heating apparatus 15, said temperature sensor being arranged directly beneath the placement surface 17 and therefore not being visible. The display apparatus 23 can determine the presence of a respective one of a plurality of predefined temperature states of the placement surface 17 with reference to temperature signals that the temperature sensor generates and outputs in dependence on the respective temperature of the placement surface 17 and can then display this respective temperature state in accordance with an illumination characteristic associated therewith.

In addition to and in parallel with the reduction of the flashing frequency, the color of the light transmitted by the multi-color LEDs additionally changes from red over orange to yellow. Provision can furthermore generally be made that the illumination element 25 transmits green light for a predefined time period, for example for 10 s, before it is fully extinguished after falling below a specific temperature, e.g. for instance 30° C. The at least substantially complete cooling of the placement surface 17 can hereby be separately signaled.

Whether the heating apparatus 15 is actually switched on or switched off and whether, in the latter case, the placement surface 17 still has a dangerously or unpleasantly high residual heat or has already cooled so much that a user can touch it without injury can be seen directly from the magnetic stirrer 11 by means of the different illumination characteristics transmitted by the display apparatus 23.

REFERENCE NUMERAL LIST

11 magnetic stirrer
13 base unit
15 heating apparatus
17 placement surface
19 operating surface
21 actuation element
23 display apparatus
25 illumination element

The invention claimed is:

1. A magnetic stirrer comprising:

a magnetic drive and a placement surface for a laboratory vessel; said laboratory vessel, containing therein a substance to be stirred, wherein the magnetic drive is configured to generate a magnetic field varying such that a magnetic stirring element positioned in the laboratory vessel can thereby be driven to make a stirring movement to stir the substance;

a heating apparatus that is configured to heat the placement surface to heat the substance; and a display apparatus comprising an illumination element controllable to transmit light; said display apparatus configured to display a respective temperature state of the placement surface, to control the illumination element to transmit light having respectively different illumination characteristics for the display of different temperature states of the placement surface and/or of different heating states of the heating apparatus, and to control the illumination element to transmit pulsing light of different pulse frequencies for a combined display of a switched off state of the heating apparatus and of different hot states of the placement surface.

2. The magnetic stirrer in accordance with claim 1, wherein the display apparatus is configured to control the illumination element to transmit light in accordance with a first illumination characteristic for a display of a switched on state of the heating apparatus; to control the illumination element to transmit light in accordance with a second illumination characteristic for a combined display of a switched off state of the heating apparatus and of a hot state of the placement surface;

and/or to control the illumination element to transmit light in accordance with a third illumination characteristic for a combined display of a switched off state of the heating apparatus and of a cool state of the placement surface.

3. The magnetic stirrer in accordance with claim 2, wherein the display apparatus is configured to control the illumination element to transmit constantly illuminating light for the display of the switched on state of the heating apparatus.

4. The magnetic stirrer in accordance with claim 2, wherein the display apparatus is configured to control the illumination element to transmit pulsing light for the combined display of the switched off state of the heating apparatus and of the hot state of the placement surface.

5. The magnetic stirrer in accordance with claim 2, wherein the display apparatus is configured to control the illumination element to transmit no light for the combined display of the switched off state of the heating apparatus and of the cool state of the placement surface.

6. The magnetic stirrer in accordance with claim 2, wherein the display apparatus is configured to control the illumination element to transmit constantly illuminating light for the display of the switched on state of the heating apparatus; to control the illumination element to transmit pulsing light for the combined display of the switched off state of the heating apparatus and of the hot state of the placement surface; and/or to control the illumination element to transmit no light for the combined display of the switched off state of the heating apparatus and of the cool state of the placement surface.

7. The magnetic stirrer in accordance with claim 1, wherein respective illumination characteristics for displaying different temperature states of the placement surface differ with respect to a pulse frequency, a color and/or a brightness of the respective light transmitted by the illumination element.

8. The magnetic stirrer in accordance with claim 1, wherein the magnetic stirrer comprises an actuation element, with the display apparatus being provided at the actuation element.

9. The magnetic stirrer in accordance with claim 1, wherein the magnetic stirrer comprises a temperature sensor for detecting a respective temperature of the placement surface, with the display apparatus being configured to determine and display the respective temperature state of the placement surface in dependence on the respective temperature detected by means of the temperature sensor.

10. The magnetic stirrer in accordance with claim 1, wherein the magnetic stirrer comprises a base unit having a power supply for the magnetic drive, for the heating apparatus, and for the display unit, with the heating apparatus being formed separately from the base unit, and being arranged at the base unit, and having the placement surface;

and with the display apparatus being provided at the base unit.

11. The magnetic stirrer in accordance with claim 10, wherein the heating apparatus is a hotplate.

12. The magnetic stirrer in accordance with claim 1, further comprising: an actuation element for switching and/or adjusting the heating apparatus, wherein the actuation element is a single element including a rocker switch, a push button, a rotary knob, a touch-sensitive input element, or similar; and a display apparatus arranged to encompass the actuation element; said display apparatus configured to display a respective temperature state of the placement surface and to display a respective heating state of the heating apparatus.

13. The magnetic stirrer in accordance with claim 1, further comprising: an actuation element for switching and/or adjusting the heating apparatus; wherein the display apparatus is integrated in the actuation element and the actuation element is a single element including a rocker switch, a push button, a rotary knob, a touch-sensitive input element, or similar.

* * * * *